US007841161B2

(12) United States Patent
Cheng et al.

(10) Patent No.: US 7,841,161 B2
(45) Date of Patent: Nov. 30, 2010

(54) METHOD OF INDUSTRIALLY PRODUCING YARN AT A LOWER TWIST MULTIPLIER FOR TEXTILE PRODUCTS

(75) Inventors: Chi Ping Cheng, Hong Kong (HK); Allan Ki Luk Chick, Hong Kong (HK); Xiao-ming Tao, Hong Kong (HK)

(73) Assignees: The Hong Kong Polytechnic University, Hung Hom, Kowloon (HK); Central Textiles (Hong Kong) Ltd., Tsuen Wan, New Territory (HK)

( * ) Notice: Subject to any disclaimer, the term of this patent is extended or adjusted under 35 U.S.C. 154(b) by 513 days.

(21) Appl. No.: 11/822,043

(22) Filed: Jul. 2, 2007

(65) Prior Publication Data

US 2009/0007538 A1 Jan. 8, 2009

(51) Int. Cl.
*D01H 7/52* (2006.01)

(52) U.S. Cl. ..... 57/75; 57/332

(58) Field of Classification Search ..... 57/75, 57/332–349
See application file for complete search history.

(56) References Cited

U.S. PATENT DOCUMENTS

| | | | | |
|---|---|---|---|---|
| 2,590,374 | A | 3/1952 | Hugh et al. | |
| 2,981,050 | A * | 4/1961 | Dewhirst | 57/75 |
| 4,147,019 | A * | 4/1979 | Novak | 57/66 |
| 6,860,095 | B2 | 3/2005 | Tao et al. | |
| 7,096,655 | B2 | 8/2006 | Tao et al. | |
| 2005/0268591 | A1 * | 12/2005 | Tao et al. | 57/75 |

* cited by examiner

*Primary Examiner*—Shaun R Hurley

(57) ABSTRACT

The present invention relates to a machine, a system, and textiles resulting from an industrially produced yarn, created through the incorporation of a linear false twisting device and two lappets positioned to affect a yarn during drafting. The invention results in a yarn having a low twist multiplier. The textiles products created from the produced yarn exhibit a soft feel without requiring the use of chemical treatments.

15 Claims, 5 Drawing Sheets

METHOD OF INDUSTRIALLY PRODUCING YARN AT A LOWER TWIST MULTIPLIER FOR TEXTILE PRODUCTS

BACKGROUND

Industrially producing yarn involves a balance between incorporating new technology into yarn production while not having to increase price so significantly as to deter consumers from purchasing technological benefited yarn products. Yarn prices are set by energetic competition and unless the total cost is less than the market price for the particular quality of yarn, it is unlikely that the manufacturing operation will survive, irrespective of the technology utilized.

Total cost can be based on a number of factors, including new materials, energy (power), shipping, storage, new technological implementation, and labor costs just to name a few. A manufacturer that can implement new technology while only slightly increasing cost is able to industrially produce a high quality, technology enhanced yarn. However, many new technologies developed for yarn production are not suitable for industrial production. The new technologies simply increased the total cost well over market price.

Twisting is a major factor of yarn spinning. In the twisting process, the fiber is firstly drafted and then twisted once or more to provide an essential amount of yarn strength, wear resistance, smoothness, and so on. False twist texturing is a type of twist. A running yarn twisted causes false twist to be trapped between a roller system and a false twisting device. The feed yarn has little or no twist, the yarn between the roller system and the false twisting device has a false twist, and the yarn leaving the false twisting device has the same twist as the input. However, when the twisting process is varied or out of control, unwanted residual torque would be retained in the yarn, which may affect the yarn breakage rate in the ring spinning machine, and further influence the quality of the yarn and the downstream processes. Hence, twisting process control is important.

Twist must run back as close as possible to the nip of the rollers, but never penetrates completely because after leaving the rollers, the yarns (in the case of two or more yarns) have to be diverted inwards and wrapped around each other. There is always a triangular bundle of fibers without twist at the exit of the rollers. This is called the "spinning triangle". Most of the end breaks of the yarn originate at this point.

The prior art shows efforts trying to minimize the yarn breakage rate by lowering the speed of the yarn or increasing the twist on the yarn. However, this type of arrangement may lead to non-symmetry pattern and spiralty in knitted fabric. Additional treatments are required to overcome defects, leading to higher production costs.

U.S. Pat. No. 2,590,374 exhibits devices for applying false twist to yarn or thread. The twisting element can be formed of an endless belt. However, this arrangement still exhibits limited twist due to yarn breakage exhibited in the triangular zone. U.S. Pat. No. 6,860,095 teaches a false twisting device, however, this arrangement does not allow for industrial production as each false twisting device requires its own motor. Along a spinning machine, with each false twisting device requiring its own motor, the production costs for yarn would likely be extremely high.

Lappets have been known to be used in spinning machines. In use, the lappets guide the yarn to a spindle. Usually, only one lappet is used. As known in the art, the whirling length of yarn between a lappet and spindle produces yarn tension. Too high tension above the lappet leads to high frequency of end breaks. Too high tension below the lappet leads to reduction in yarn quality. Movable lappets that can be raised or lowered have been known in the art, however the raising of lowering of the lappet has been reported as having a negligible influence on the resultant yarn.

Resultant yarn is also subject to count (Ne). The higher the count, the softer feel for the yarn. However, the count level is partly limited by spindle spin. Spindle spin must operate in a particular range to avoid yarn breakage. As a result, to obtain a softer feel yarn many manufacturers chemically treat the yarn in order to produce softer feeling products. However, chemical treatments can expose textile wearers to harmful byproducts and side effects when worn for a sufficient period of time.

It is an object of the present invention to overcome the disadvantages and problems in the prior art by teaching a machine for industrially producing, low twist yarn to be used in the manufacture of soft feel textile products.

DESCRIPTION

The present invention proposes a machine and method for industrially producing a yarn at a low twist multiplier (T.M.).

The present invention also proposes textile products made by the present industrially produced yarn, such textile products exhibiting at low twist multiplier without requiring the use of chemical treatments.

The present invention further proposes the industrial production of the instant yarn by incorporating a twist multiplier extending the entire length of a spinning machine, and two lappets positioned on every ring frame on the spinning machine.

These and other features, aspects, and advantages of the apparatus and methods of the present invention will become better understood from the following description, appended claims, and accompanying drawings where:

Figure 3A:
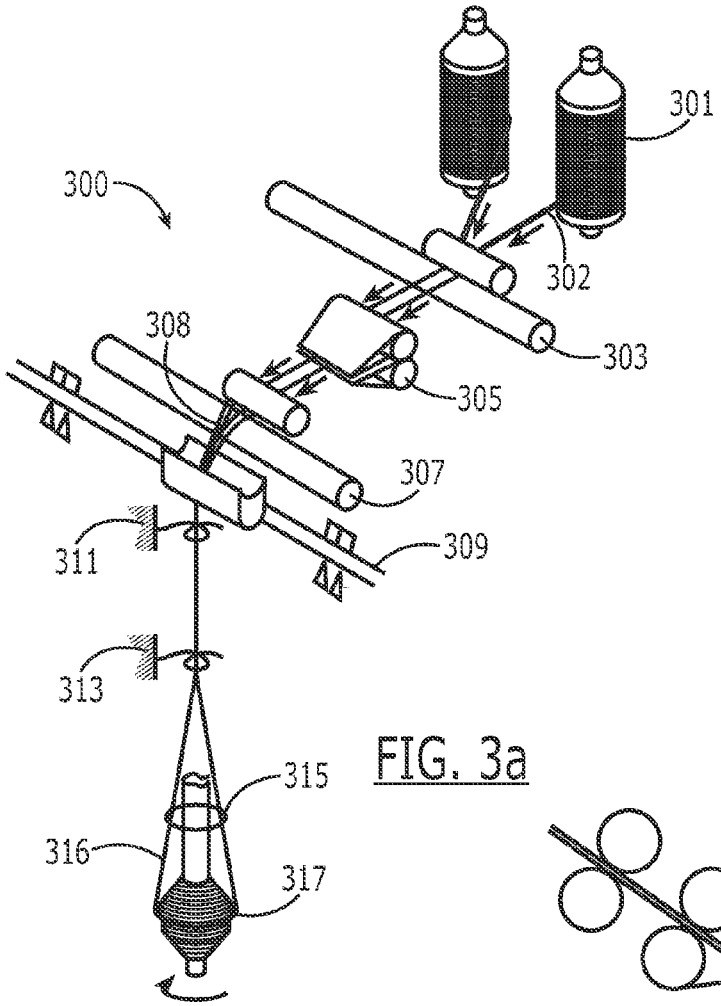
FIG. 3(*a*) shows a ring frame as used in the present invention.
Figure 3B:
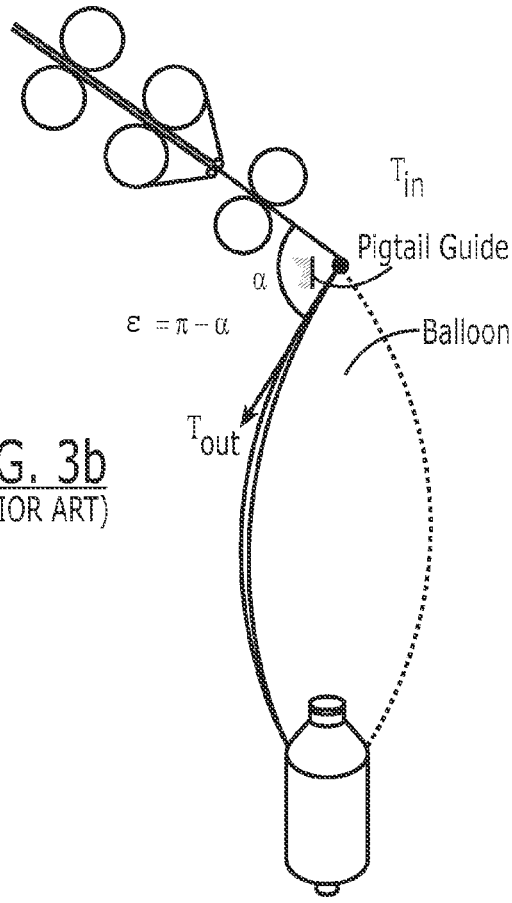
FIG. 3b (PRIOR ART)

FIG. 3(*b*) exhibits the formation of a balloon in accordance with the prior art.

Figure 4:
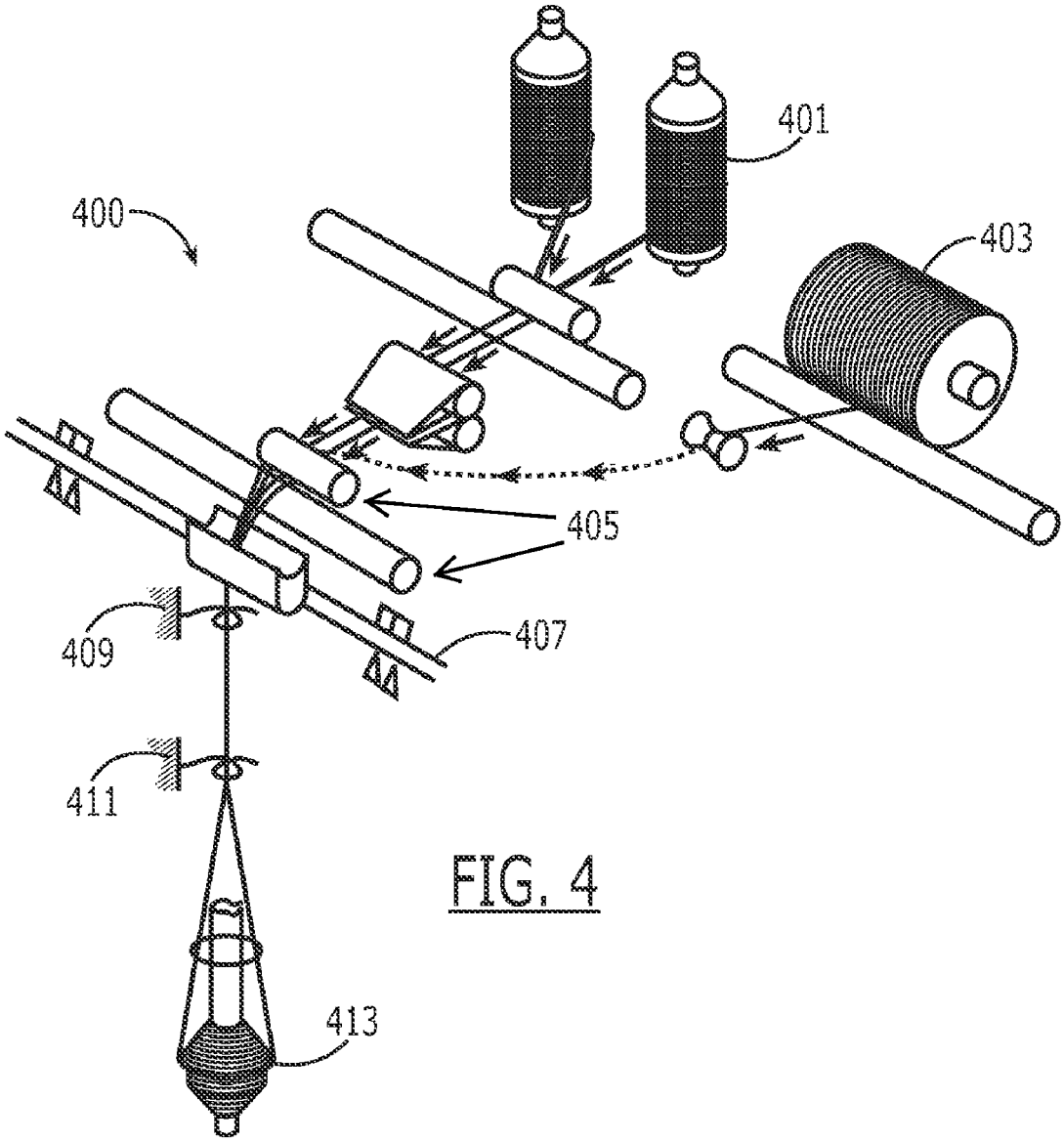

FIG. 4 shows a ring frame as used in the present invention, incorporating a core spandex filament roving.

Figure 5:
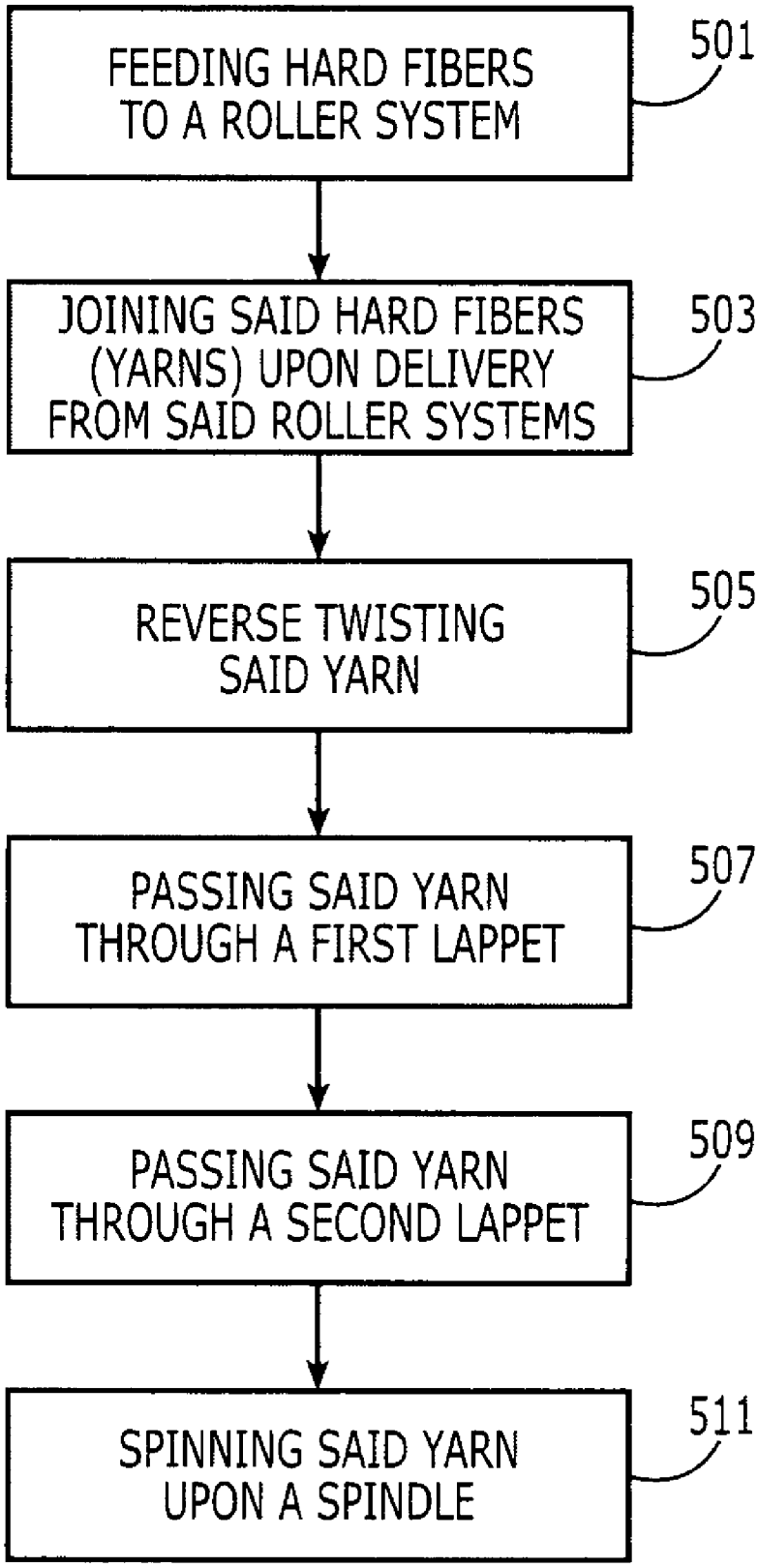

FIG. 5 details the method of manufacturing a yarn in accordance with the present invention.

Figure 6:
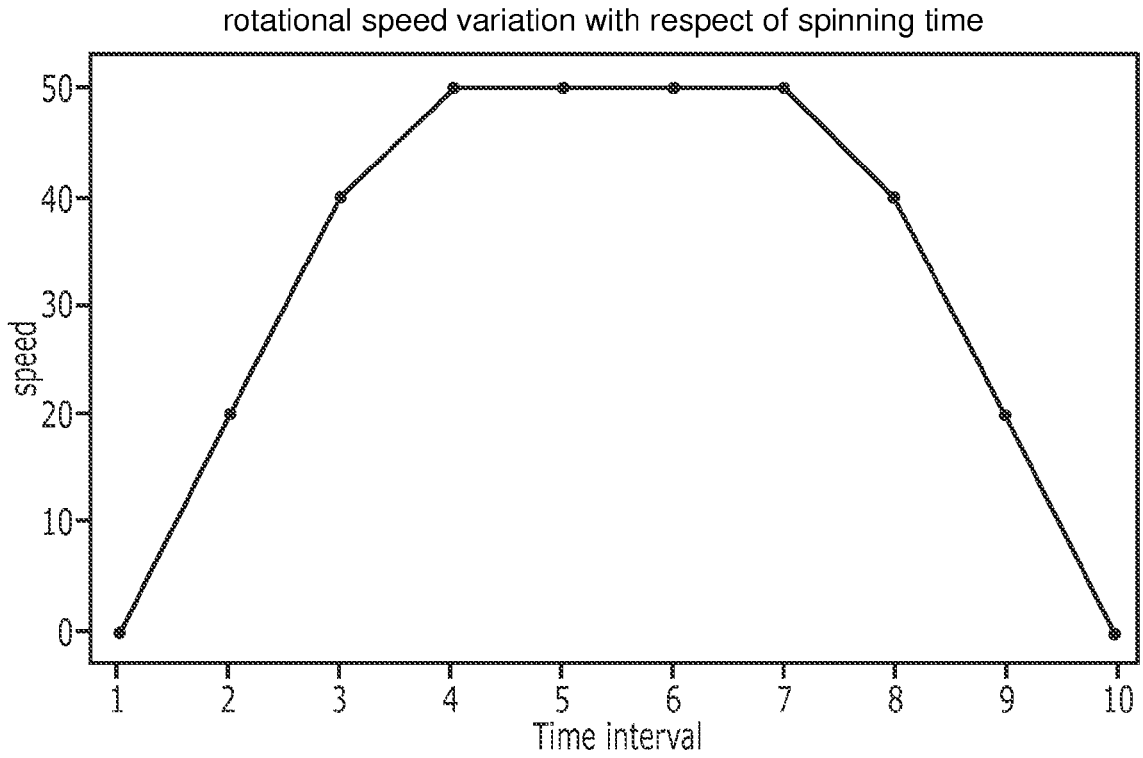

FIG. 6 graphs rotational speed of a spindle of the present invention against time.

The following description of certain exemplary embodiment(s) is merely exemplary in nature and is in no way intended to limit the invention, its application, or uses. Throughout this description, the term "industrially produced" and derivative tenses, shall refer to methods of manufacturing product taking economics into account, such as raw material cost, energy cost, and the like. "Industrially producing" shall also refer to large scale manufacture of a product as opposed to small scale manufacture. In comparison to bench or laboratory production, "industrially producing" balances sale costs of the final produce product against costs involved with incorporating new technology in scale-up production. The term "chemical treatment" shall refer to chemical and/or physiochemical techniques applied to yarn or yarn products to improve their performance using physical, chemical, and/or biological agents.

Now, to FIGS. 1-6,

The present invention provides a ring spinning machine for industrially producing a yarn having a yarn count (NE) between 32 to 100, preferably 34 to 100 Ne, and a twist multiplier (T.M.) down to T.M. 2.0, and capable of processing other spinal yarns as slub yarn, core spun yarn core filament yarn, and the like with T.M. 30% lower than previous methods which is unable to be produced normally by conventional ring spinning machines. The machine is suitable for providing yarn suitable for generating a non-chemically treated soft yarn product, such as shirts, sweaters, pants, undergarments and the like, having a clear and smooth fabric surface and soft handle. The present invention also relates to methods for producing such yarn.

Figure 1:
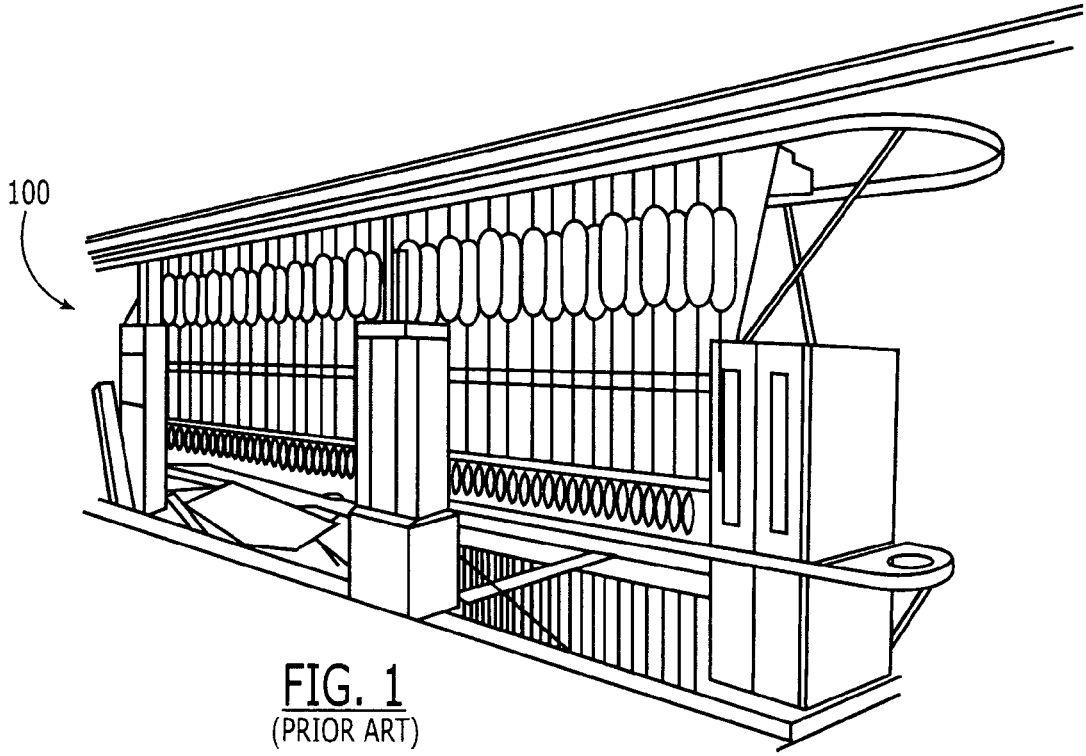
FIG. 1 (PRIOR ART)
FIG. 1 shows a spinning machine as used in the prior art, the spinning machine including the components ring frame.

FIG. 1 is an embodiment of a ring spinning machine 100 of the prior art. Generally, such a machine has multiples of ring frames mounted on both sides. Ring frames are composed of spindles, rollers, and rovings. In such a machine, at least 85% of the total power requirement is consumed in driving the spindles. The resultant yarn is based upon details such as desired yarn count, package size, spindle speed, and necessary productivity.

Figure 2:
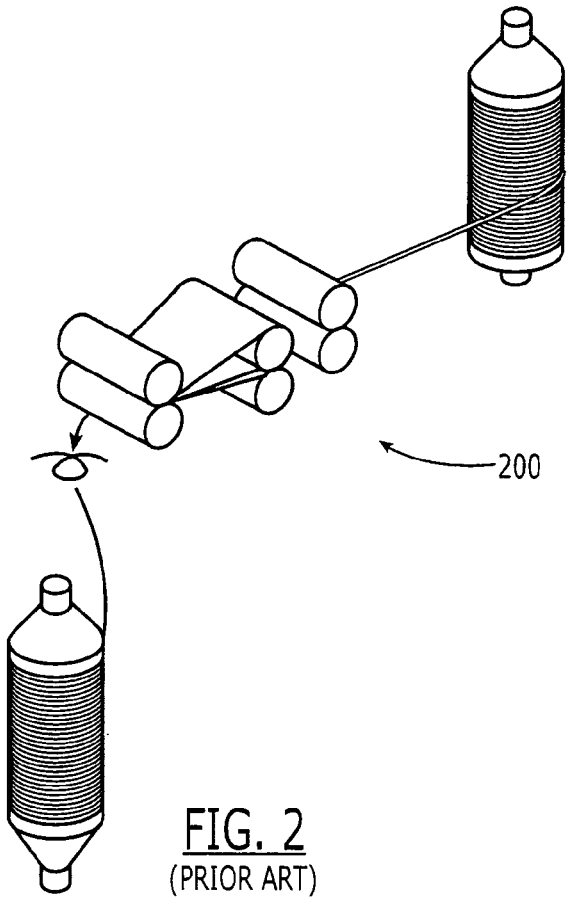
FIG. 2 (PRIOR ART)
FIG. 2 shows a prior art ring frame as used in a spinning machine of the prior art.

FIG. 2 is an embodiment of a prior art single ring frame ring spinning machine 200. In such ring frame, a roving input is used to provide a yarn to rollers, a lappet, and a spindle. Ring frames in the prior art incorporate one lappet, such lappet being used to guide the yarn from the rollers to the spindle. The prior art has shown the use of only one lappet as suitable for guiding the yarn. Generally, the rollers are positioned with respect to the guide so that the yarn engages the spindle and the arrangement should be such that the yarn is deflected from its normal path by the spindle.

The present invention relates to a ring spinning machine having multiples of ring frames, used to industrially produce yarn with a count of 32 to 100, preferably 34 to 100 Ne, and a twist multiplier down to 2.0. The machine has ring frames, numbering from 48 to 504 per side. The present invention also relates to the ring frames used in the machine. Further, the present invention relates to products resulting from the produced yarn, such products being non-chemically treated, soft feel textiles.

FIG. 3(*a*) is an embodiment of a ring frame 300 used in the spinning machine of the present invention. Each ring frame 300 can include at least two bobbin lead rovings 301, rollers (303, 305, 307) a linear false twisting device (309), lappets (311, 313), and a spindle system (316).

At least two bobbin lead rovings 301 can be included in the frame 300. The lead rovings 301 are used to feed the roving 302 to the back roller 303. Examples of roving 302 to be fed include cotton, wool, cashmere, silk, linen, bamboo, hemp, rayon, acrylic, nylon, and blends of various fibers. The yarns variety can be fibers, fancy yarns, spun slubs, core spun yarns, and the like.

In operation, the yarns are drafted simultaneously into the back roller 303.

The back roller 303 can be made of materials well-known in the art, including aluminum alloy, and incorporate ball bearings. The back roller 303 can consist of a top and bottom piece. As is well-known in the art, the top back roller should operate (roll) clockwise; the bottom back roller should roll counter-clockwise. Proceeding through the back rollers 303, the roving 302 are fed to a middle roller 305. The middle roller 305 is focused on applying lateral pressure to the roving 302 assembly, thereby increasing interfiber function. The middle roller 305 can be selected from the group consisting of double aprons, pressure bar, and apron and pressure pads. In one embodiment, the middle roller 305 is a double apron.

The roving 302 are then fed to a front roller 307. As with the back roller 303, the front roller 307 can be made of materials well known in the art. The rovings 302 drafted join together after exiting from the front roller 307, and pass down to the linear false twisting device 309.

It is important to note the creation of a spinning triangle 308 created by the yarns as they exit the front roller 307. As known in the art, the majority of end breaks of the yarn occur between the front roller and the lappet. The prior art has attempted to address such end breaks by lowering the spindle speed or increasing the twist on the yarn. However, lowering the speed or over-twisting the yarn can lead to non-symmetrical pattern and spiralty in knitted fabric. Further, such treatments increase production costs by extending the period of drawing the yarn, and/or requiring additional energy to over-twisting the yarn. This results in increasing production costs of yarn product.

In the present invention, upon exiting the front rollers 307, the yarns enter into a triangular zone 308, are joined and the one resultant yarn is contacted by the linear false twisting device 309.

The linear false twisting device 309 is a continuous, conveyor belt type runner, wherein the runner is made of a friction surface to engage the yarn 315. In the machine of the invention, the runner extends the length of the ring frames on both sides. The linear false twisting device 309 associated with each ring frame does not include a motor; rather one motor drives the runner over one section of the entire machine, one section being between 96 to 128 spindles. The runner is capable of operating in a counterclockwise or clockwise manner. The width of the runner can be from 0.3 cm to about 3 cm in width. The benefit of such a runner being driven over 96 to 128 spindles by one motor is the low cost, allowing for maintaining production costs while producing a high value added product. The linear false twisting device 309 is used to provide a false twist texture to the yarn. As known in the art, twisting can provide improvement in yarn strength, wear resistance, smoothness, and the like. However, if twisting is not controlled, yarn breakage rate may increase and the quality of the yarn may be negatively affected.

Through the linear false twisting device 309 of the instant invention and its position in the machine, the yarn can be run with a lower twist while exhibiting and improved triangular zone 308 because of the use of at least two rovings 301. This minimizes yarn breakage while allowing better twisting control, thus producing a high count, low twist, soft feel yarn. The machine of the present invention incorporates multiples of ring frames having the false twisting devices driven by one motor per 96 to 128 spindles. This allows the production of the high quality yarn without increasing production costs. The linear false twisting device 309 may operate in a clockwise or counter-clockwise manner.

In operation, the yarn exits the front roller 307 to onto the linear false twisting device 309. The exiting yarn exhibits an angle of from −15° to −45° from the exit plane.

A first lappet 311 is positioned below the linear false twisting device 309. The lappet 311 is positioned such that it is able to effect the amount of reverse twist applied to the yarn. In a preferred embodiment, the inner arc of the lappet 311 is about 1 mm horizontal distance over the false twisting device 309. The first lappet 311 effects the tension on the yarn, where if the tension is too high, yarn breakage will likely result or if the tension is insufficient, the resultant yarn has poor appearance and poor hand feel. The necessity of balancing tension with end product quality has let to yarn and product made these with of low to medium quality. The present invention minimizes the effect of the balance, as discussed shortly.

A second lappet 313 is also positioned in the ring frame from about 5 cm to about 10 cm below the first lappet 311.

With reference to FIG. 3(*b*), as the yarn 315 is wound upon the spindle 316, the yarn "balloons" outwards from spindle system 316. When wound at a high enough speed, the yarn outline forms a transparent balloon. As stated previously, a lappet affects the tension of the yarn. While not to be bound by theory, tension of a alarm yarn can be defined as:

$$T_{out}=T_{in}e^{N\epsilon}$$

Where $T_{out}$=tension of the yarn exiting the lappet, $T_{in}$=tension of the yarn as it leaves the triangular zone and enters the lappet, and $\epsilon=\pi-\alpha$, where $\alpha$ is the angle between $T_{in}$ and $T_{out}$. As the point at which the yarn exits the triangular zone is the weakest point, $T_{in}$ is kept below the breaking strength of the yarn, and thus $T_{out}$ is kept at a below level.

At a below level $T_{out}$, spindle speed when collecting the yarn should be operated at a slower velocity to avoid over-expansion of the balloon. The spindle speed operated at slower speed hinders the creation of yarn with high count.

Through the present invention, notable through the strategic incorporation of a second lappet 313, a higher yarn count is obtainable in comparison with the prior art. Again, not to be bound by theory, it is believed that through the use of the second lappet 313, $T_{in}$ can be increased because the angle between $T_{out}$ and $T_{in}$ has been increased (as the yarn is further directed downward as opposed to immediately a balloon leaving the first lappet forming the balloon). An increase in $T_{out}$ can allow an increase in spindle speed, thus collecting a yarn with a higher spinning count.

Additionally, the use of the second lappet 313 decreases the height of the balloon. It has been postulated that the height of the balloon affects its diameter when spinning, and thus the resulting yarn count.

As stated, the yarn is round on a spindle system 316. The spindle system 316 includes a balloon control ring 315, for controlling the surface area of the balloon, and a traveler 317 for contacting the yarn 315.

FIG. 4 is an embodiment of a ring frame 400 of the present invention, including at least two bobbin lead rovings 401, spandex/filament 403, rollers 405, a linear false twisting device 407, lappets (409, 411), and a spindle system 413. In this ring frame 400, the core spandex/filament 403 is guided by a training roller to the rollers 405. In operation, the spandex/filament 403 is guided to the centre of the roving 401 and are twisted together. A false twist is given to the yarn by the linear false twisting device 407. The false twisting device 407 can rotate clockwise (S-twist) or anti-clockwise (Z-twist). The yarn passes through lappets (409/411) strategically positioned apart. The yarn is then spun on the spindle system 413.

FIG. 5 is an embodiment of a method of making a yarn having a low twist multiplier T.M., defined as a T.M. of 2.0 to 2.3 and having a spun yarn count (Ne) of between 32-100 Ne, preferably 34-100 Ne, and capable of processing other spinal yarn such as slub yarn, core spun yarn, core filament yarn, and the like, including the steps feeding hard fibers to a roller system 501, joining the hard fibers (i.e., "yarns") together upon exiting the roller system 503, reverse twisting the yarn 505, passing the yarn through a first lappet 507, passing the yarn through a second lappet 509, and spinning the yarn on a spindle 511.

Feeding hard fibers to a roller system 501 relates to directing fibers from two or more roving bobbins to the back roller of a roller system. Suitable hard fibers include cotton, wool, cashmere, silk, linen, bamboo, hemp, rayon, acrylic, nylon, and blends thereof. They can be of the variety such as fishes, spun slubs, core spun yarns, and the like. The roller system can be made of one or more rollers, including but not limited to back rollers, front rollers, double aprons, pressure-bar, flume, and the like.

The fibers are joined together after their delivery from the roller systems 503. Specifically, joining together occurs after the triangular zone created between the points of the yarns exiting the roller system and their joining together. The tip of the triangular zone, i.e., the point at which the yarns join together, is the point most susceptible to the yarn end breakage. Through the present method, yarn breakages are minimized even while providing a yarn with good count and low twist level.

Following the roller system, the yarn is reverse twisted 505 by a false twisting device. Reverse twisting can occur clockwise or counterclockwise, at a speed that is preferably proportional to the delivery speed of front rollers if the roller system. Reverse twisting occurs by sufficiently contacting the yarn as it progresses downward to the spindle. Sufficient contact can be made by allowing the yarn to contact the linear false twisting device at about 45°. In a preferred embodiment, the yarn contacts the moving belt of the false twisting device at about 45° angle. Further, the reverse twisting speed may be adjusted in relation to the spindle speed. In one embodiment, the reverse twisting speed can be about 4 to 40 times of the spindle speed. The reverse twisting speed can be adjusted by a speed controller attached to a driving motor.

After reverse twisting, the yarn is passed through a first lappet 507. The first lappet can be positioned several millimeters below the moving belts of the false twisting device, and 0.5 mm to 5 mm in front of the moving belt. The yarn is passed through the lappet such that the yarn contacts the rear/back part of the lappet.

The yarn is then passed through a second lappet 509. The second lappet is positioned directly below the first lappet. The yarn can pass through adjacent to the rear/back of the lappet.

The yarn is then wound on a spindle. Winding occurs in accordance with techniques known in the art. In one embodiment, a balloon ring is included on the spindle to control the balloon developed during winding. As stated, the winding speed is about 4 to 40 times less than the reverse twisting speed.

Through the present method, the resultant yarn exhibits a low twist, down to T.M. 2.0 and a count between 32 to 100 Ne, preferably 34 to 100 and capable of processing other yarns as slub yarn, core spun yarn, core filament yarn, and the like with T.M. 30% lower than previous method. The yarn has a symmetrical stitch shape, a clear and smooth fabric surface, and a soft handle. The present method, while providing a high value yarn, does not sacrifice productivity cost necessary to bring the yarn to market. This is mainly obtained by driving multiples of linear false twisting device, and utilizing two lappet which said in decreasing chance of yarn breakage. The yarn is capable of being useful for making products such as sweaters, shirts, towels, undergarments, pants, and the like. The products resulting from the present method are capable of soft feel and durability, arising from low twisting and good yarn count, without requiring chemical treatments.

FIG. 6 shows the relationship between the reverse twisting speed and the spindle spinning time. As shown, the reverse twisting speed is adjusted via a speed controller, as the yarn is wound on the spindle.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A method of producing a yarn having a count between 6 and 100 Ne, comprising the steps, feeding fibers, from at least two bobbin lead rovings, to a roller system;

joining said fibers, now yarn, upon delivery from said roller system;

reverse twisting said yarn using a linear false twisting device, the yarn contact with a belt of the linear false twisting device at an angle between 15 to 45 degrees;

passing said yarn through a first lappet;

passing said yarn through a second lappet; and spinning said yarn upon a spindle, wherein the second lappet is 5 cm to 10 cm below the first lappet, and is configured to increase spinning speed of the spindle, and increase spin count of said yarn.

2. The method of producing a yarn in claim 1, wherein said yarn is selected from the group consisting of slub yarn, core spun yarn, and core filament yarn.

3. The method of producing a yarn in claim 1, wherein said fibers are delivered from at least two roving bobbins.

4. The method of producing a yarn in claim 1, wherein said fibers are joined following delivery from a back roller.

5. The method of producing a yarn in claim 1, wherein reverse twisting speed is between 4 to 40 times speed of spinning the yarn on the spindle.

6. The method of producing a yarn in claim 1, further comprising the step of adjusting the speed during reverse twisting said yarn.

7. A non-chemically treated textile product having a count between 32 and 100 Ne, whereby said textile product contains a yarn produced by drafting said yarn through a false twisting device and a first lappet and second lappet while being wound on a spindle, wherein the yarn contact with a belt of the linear false twisting device at an angle between 15 to 45 degrees, and wherein the second lappet is 5 cm to 10 cm below the first lappet, and is configured to increase spinning speed of the spindle, and increase spin count of said yarn.

8. The non-chemically treated textile product of claim 7, wherein said yarn is selected from the group consisting of cotton, wool, cashmere, silk, linen, bamboo, hemp, rayon, acrylic, nylon, and blends thereof.

9. The non-chemically treated textile product of claim 7, wherein said textile product is selected from the group consisting of sweaters, shirts, towels, undergarments, and pants.

10. A ring spinning machine comprising 48 to 504 ring frames per side, each of said ring frames including the components:

at least two bobbin lead rovings adapted to supply fibers;

a roller system adapted to join the fibers and form yarn;

a linear false twisting device adapted to reverse twisting said yarn, the yarn contact with a belt of the linear false twisting device at an angle between 15 to 45 degrees, the linear false twisting device is a continuous conveyor belt-type runner extending the entire length of the ring frames;

a first lappet;

a second lappet;

a spindle system; and a motor for driving said linear false twisting device, a controller for said motor, and a belt drive positioned between said motor and said linear false twisting device, wherein the second lappet is 5 cm to 10 cm below the first lappet, and is configured to increase spinning speed of the spindle system, and increase spin count of said yarn.

11. The ring spinning machine of claim 10, wherein said bobbin lead rovings possess yarn of the variety selected from the group consisting of fibers, fancy yarns, spun slubs, and core spun yarns.

12. The ring spinning machine of claim 10, wherein said roller system includes one or more of a back roller, a middle roller, and a front roller.

13. The ring spinning machine of claim 10, wherein the first lappet and second lappet positioned parallel to each other.

14. The ring spinning machine of claim 10, wherein the first lappet having an inner arc that is positioned about 1 mm horizontally from said linear false twisting device.

15. The ring spinning machine of claim 10, wherein said spindle system further comprises a balloon control ring and a traveler.

* * * * *